United States Patent [19]

Dammert et al.

[11] 4,364,018

[45] Dec. 14, 1982

[54] COMPACT MINIRELAY

[76] Inventors: Wolfgang Dammert, Ludwigstrasse 32, D-8672 Selb; Horst Enge, Hauptstrasse 18, D-8671 Schonwald, both of Fed. Rep. of Germany

[21] Appl. No.: 55,767

[22] Filed: Jul. 9, 1979

[30] Foreign Application Priority Data

| | | | |
|---|---|---|---|
| Jul. 8, 1978 | [DE] | Fed. Rep. of Germany | 2830074 |
| Jul. 18, 1978 | [DE] | Fed. Rep. of Germany | 2831432 |
| Jul. 18, 1978 | [DE] | Fed. Rep. of Germany | 2831438 |
| Jul. 21, 1978 | [DE] | Fed. Rep. of Germany | 2840998 |

[51] Int. Cl.[3] ..... H01H 9/02

[52] U.S. Cl. ..... 335/202; 335/106

[58] Field of Search ..... 335/106, 128, 202, 203

[56] References Cited

U.S. PATENT DOCUMENTS

| | | | |
|---|---|---|---|
| 3,171,918 | 3/1965 | Killion | 335/202 X |
| 3,811,102 | 5/1974 | Ash | 335/106 |
| 3,833,869 | 9/1974 | Cassarly et al. | 335/106 |
| 4,045,752 | 8/1977 | Frigo | 335/203 X |
| 4,112,399 | 9/1978 | Prachen et al. | 335/202 X |
| 4,227,162 | 10/1980 | Fujita et al. | 335/202 |

*Primary Examiner*—Robert J. Hickey

*Attorney, Agent, or Firm*—Bacon & Thomas

[57] ABSTRACT

A compact minirelay having a coil, armature and springs housed in a molded housing. Electrical connections for the relay extend through side walls of the housing along the interface between plate parts or between side walls and plate parts. The connections are seated in recesses at the interface and are interlocked with the housing parts which are then bonded together. A snap-on cover is provided.

6 Claims, 12 Drawing Figures

15

13
37
4

36
8'
7'
6'
23
27
26

33
28
8
7
6
29
26
9
24''
24
26
25
24'
27
23
9
31
32
7
6
8

COMPACT MINIRELAY

BACKGROUND OF THE INVENTION

The invention concerns a compact minirelay with a box-like housing for the excitation winding, the yoke and the armature, together with the switch and contact springs, the connections whereof pass tightly through the walls of the housing, and a snap-on cover that may be placed on the housing over its open side.

In known minature relays the connections are passed through the side walls of the housing. The connections further display bends at their internal ends to which the excitation winding connects and the switch springs or stationary switching contacts are fastened. In order to obtain the necessary tightness and to secure the contacts in their passage through the material of the housing, they are sealed in by injection molding. It has been found that this method of the application of the connections requires an expensive effort in production technology.

SUMMARY OF THE INVENTION

This problem is solved according to the invention by designing the housing in the form of a pan open on one side and of plate parts or the like, securely mounted externally on two opposite side walls of said pan, the connections of the switching and contact springs being arranged securely and tightly in the common interfaces of the side walls and the plate parts, together with the connections of the excitation winding. The pan consists conveniently of a flat bottom part and molded integral circumferential side walls. To secure the connections in the housing, therefore only simple insertion processes and an adhesive bonding or welding process, respectively, for the plate parts, are required. It is obvious that through the choice of side walls and plate parts of arbitrary thickness, adequate mechanical and electrical safety conditions may be provided and a compact design may be achieved.

The layout of the relay is such that the connections may be inserted in a positively locked manner in recesses provided in the side walls and/or the plate parts, wherein the connections are held securely against shifting by means of projections, protrusions or the like provided integrally on the side walls and engaging holes in said connections.

In a further development, the plate parts are placed at least in sections so as to project over the open side of the pan and the projecting sections utilized for the securing in place of the yoke and the armature retaining spring.

It is further provided that the plate parts and the side walls of the pan extending transversely to said plate parts at their ends facing away from the bottom part have a circumferential seam to receive a snap-on cover, which in the case of relays with several sets of springs may have a molded-on shoulder or several shoulder sections, projecting into the the spaced between the sets of springs as an electrically separating element. The shoulder or shoulder sections make it possible to maintain air or leakage distances of predetermined magnitude.

In a still further embodiment of the compact minirelay, it is provided that the connections may also be arranged without sliding and tightly in the interface between two plate parts solidly bonded to each other and securely fastened to at least one side wall of the pan. The plate parts thus form a single structural unit with the connections, said structural unit being applicable as such to the pan. For this purpose, independent plate parts that may be joined together by adhesive bonding or welding, or a single injection molded part accepting the connections in molded passages, may be provided.

Conveniently, in one plate of the pairs of plate parts, recesses for the positive acceptance of the connections are provided, possibly together with integrally shaped projections or the like, which secure the connections in place, while ribs or other protuberances in the interface of the plate parts and on the lateral surface facing the pan provide a tight and solid bond by means of fusion welding.

According to a further embodiment of the compact minirelay, the plate-like bodies carrying the connections are arranged fixedly on the legs and the shoulder part of a U-shaped molded part. The magnet system amy then be inserted freely from above or by way of the open sides in the U-shaped pan part and a circumferentially closed pan may be obtained by fixedly securing the plate bodies carrying the connections. The application of the bodies may be facilitated by securing them interlockingly to the edge surfaces of the legs and/or the shoulder part of the U-shaped molding and fastening them by welding or adhesive bonding, especially by ultrasonic means. In order to form the interlocking parts, the legs and/or the shoulder and the plate bodies, respectively, may be provided with projections and corresponding recesses in their common interfaces.

Further, the plate bodies may have recesses in their sides facing each other for the support and immobilizing of the yoke and the armature retaining spring, whereby the yoke and the armature retaining spring engage by means of widenings, shoulders or cuts. The plate bodies may be utilized further by providing them at intervals at their end away from the shoulder part with steps forming a seam for the support of the cover, whereby the snap-on cover may be secured to the plate bodies by means of integrally molded locking bodies. The steps have an additional centering effect on the cover, which further simplifies the assembly.

Finally, measures for the simple manufacture of the connections and their bonding to the side walls and/or the plate bodies, and their further development into switching or contact elements are taken, whereby the connections are cut together and simultaneously from a flat metal strip, while retaining certain connecting strips, then welded to stationary contacts and a switching spring with switching contacts, cut free of the connecting strips, bent at their ends facing the solid contacts and the switching spring and freed of the remaining connecting strips, to be arranged subsequently in the form of a single piece cut part in or on, respectively, the side walls of the pan or the plate parts or plate bodies and rendered independent by cutting away any remaining connecting strips. These manufacturing steps lend themselves to the automation of the production of the compact minirelay.

BRIEF DESCRIPTION OF THE DRAWINGS

The invention is demonstrated with the aid of examples of embodiment in the drawing, wherein.

DESCRIPTION OF THE PREFERRED EMBODIMENTS

Figure 1:
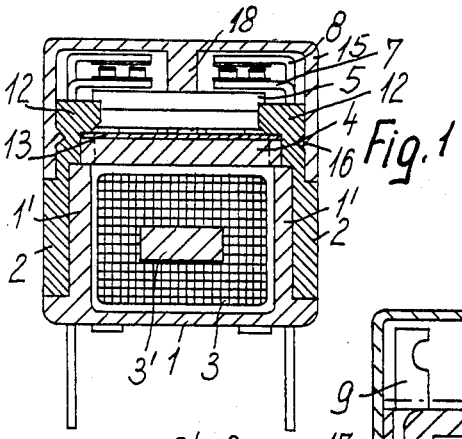
FIG. 1 si a sectional view of a compact minirelay taken on the line 1—1 of FIG. 2.
Figure 2:
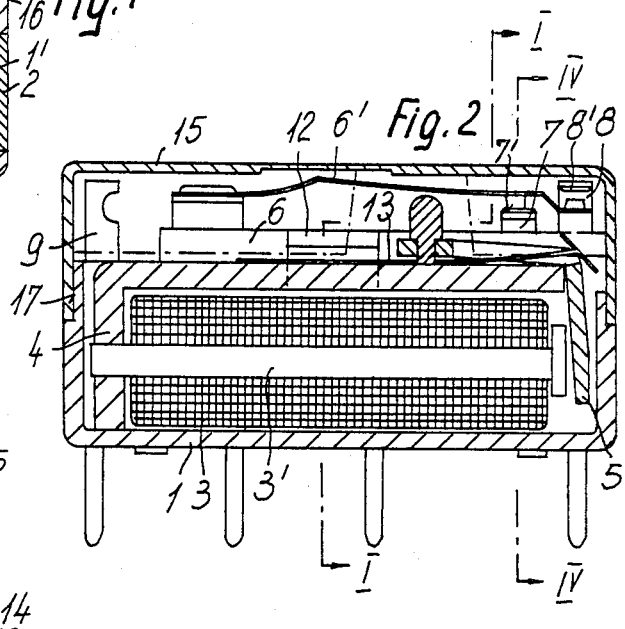
FIG. 2 is a longitudinal section of a compact minirelay.
Figure 4:
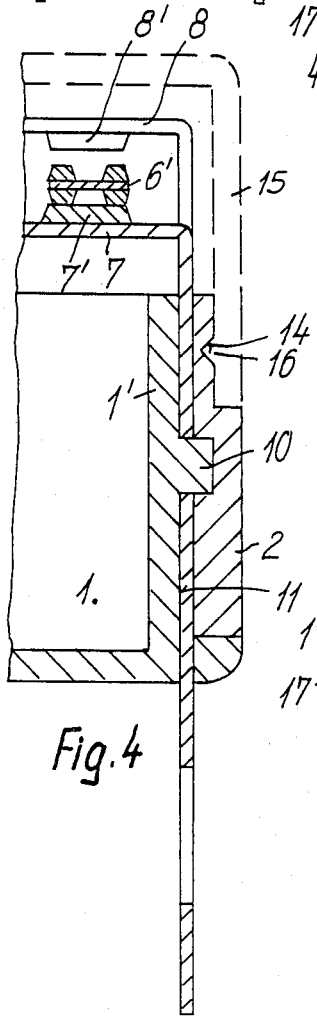
FIG. 4 is a partial sectional view taken on line IV—IV of FIG. 2, enlarged.
Figure 3:
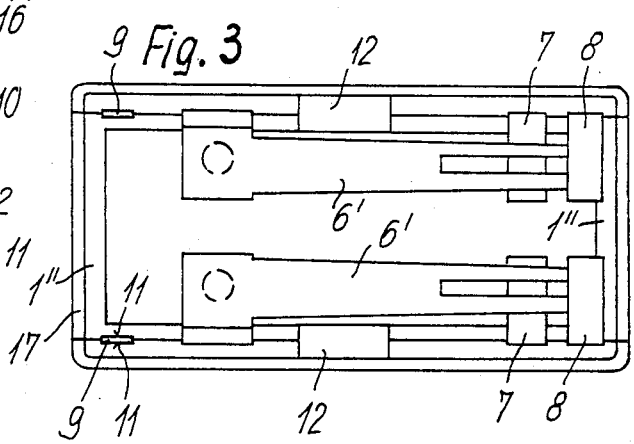
FIG. 3 is a plan view of a compact minirelay without the snap-on cover.
Figure 5:
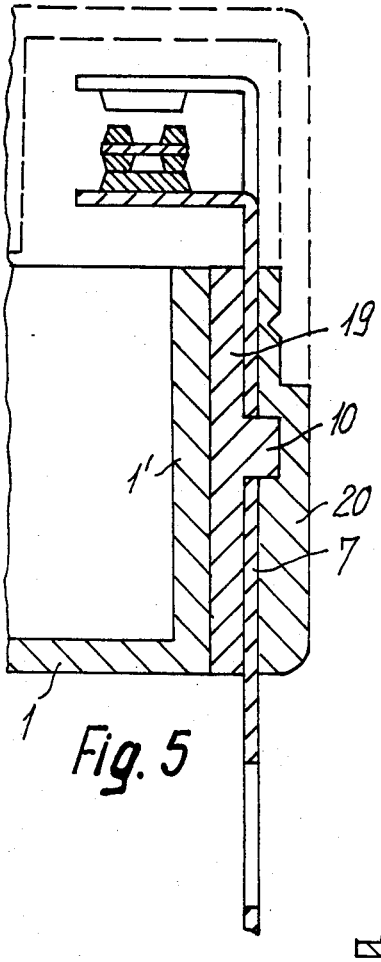
FIG. 5 is a partial sectional view of a housing.
Figure 6:
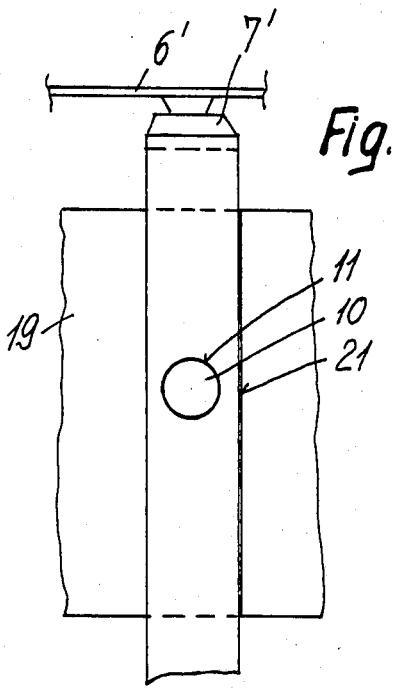
FIG. 6 is a fragmentary view of a plate body in a side elevation.
Figure 7:
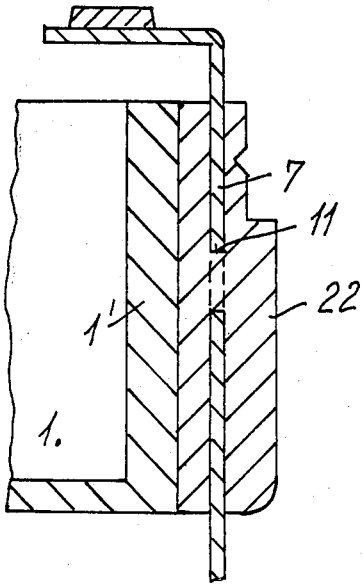
FIG. 7 is a partial sectional view of a different housing for a relay.

In the figures, 1 signifies a pan, carrying solidly mounted by means of ultrasonic welding on its lateral walls 1' externally, the plate parts 2, forming together an essentially box-shaped housing for the excitation winding 3 with its core 3', the yoke 4 and the armature 5. Further, the housing comprises the connections 6, 7, 8 and 9 for the switching springs 6' and the contact springs 7' and 8' and the excitation winding 3. According to the invention, the connections 6, 7, 8, and 9 are arranged in common interfaces of the side walls 1' and the plate parts 2, which for this purpose engage in a positively locking manner the recesses 11 of the side walls 1' and of the plate parts 2 and are retained in said recesses by means of studs 10 molded onto the side walls 1'. The plate parts 2 have sections 12 protruding over the open side of the pan 1, which, as shown particularly in FIG. 1, extend over the yoke 4 and the armature retaining spring 13 and secure the latter in the housing. The sections 12 are further provided with locking grooves 14 or the like, wherein the snap-on cover 15 locks by means of its protrusions 16. The snap-on cover 15 is thereby inserted in a seam 17 arranged on the plate parts 2 and on the side walls 1'' of the pan extending transversely to said plate parts.

The connections 6 to 9 are inserted initially in the recesses 11 of the side walls 1' to form the housing and then secured in place by the subsequent application and welding of the plate parts 2 to the side walls 1'. The connections 6 to 9 arranged in this manner safely restrict or prevent, respectively, the access of soldering and fluxing materials to the housing. The connections 6 to 8 are bent at their internal ends toward each other and carrying the switch springs 6' and the contact springs 7', 8'.

In the case of compact minirelays with two rows of laterally arranged switch and contact springs, the snap-on cover 15 is provided internally with a molded rib 18, which extends into the space between the springs 6', 7', 8' and the connections 8, respectively, and thus forms separate receiving chambers for them.

It is within the scope of the invention to have the plate parts 2 extending either over the entire height of the side walls 1' or over a portion of said height only.

In FIGS. 5 to 7, 1 again signifies a pan, with the plate parts 19 and 20 being secured to the side walls 1' thereof by welding or adhesive bonding, with the connections 6 to 9 being received and held between them. The plate parts 19, 20 are bonded together solidly and tightly be means of welding or adhesive bonding. At least one of the plate parts 19 or 20 has a prepared recess 21 within the area of the common interface, for the acceptance in a positively locking manner of the connections 6, 7, 8, 9.

The engagement of the protrusions 10 molded onto the plate part 19 in a recess 11 of the connections 6 to 9, the latter are secured without sliding between the plate parts 19, 20.

Figures 8, 9, 10, 11:
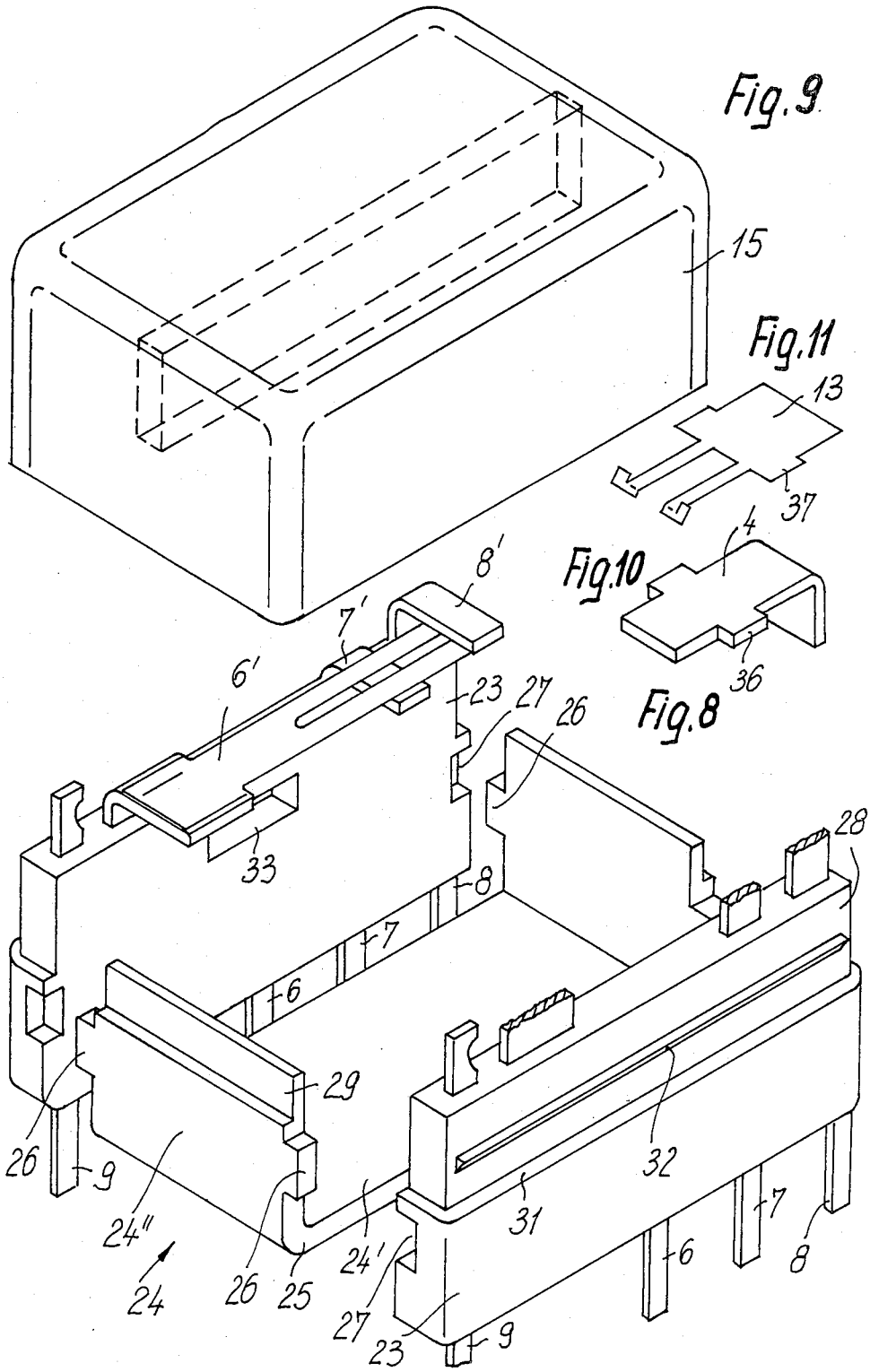
FIG. 8 is an exploded view of the pan of a compact minirelay.
FIG. 9 is a perspective view of a cover.
FIG. 10 is a perspective and reduced view of a yoke.
FIG. 11 is a perspective and reduced view of an armature spring.

In the example of embodiment of FIGS. 8–11, the connections 9,6, 7 and 8 of the excitation winding and the spring sets 6', 7', 8' are arranged solidly by molding in the plate bodies 23, said plate bodies forming, according to FIG. 8, together with the U-shaped molded part 24, a pan for the housing of the excitation winding 3, the yoke 4, the armature 5 and the armature retaining spring 13. The two plate bodies 23 are placed for this purpose on the edge surfaces 25 of the molded part 25' and the legs 24'', whereby protrusions or molded shoulders 26 engage as locking bodies the recesses 27 of the plate body 23, for the puspose of alignment and fixation, wherein the plate bodies are secured in place particularly by ultrasonic welding. The plate bodies 23 have external steps 28, which cooperate with the steps 29 in the legs 24'' and perform a centering and support function when the cover 15 is placed on the housing. The steps 28, 29 form a seam 31, which receives the cover 15, while molded parts 32, acting as locking members, secure the cover 15.

The plate bodies 23 are provided with recesses 33 on their sides facing each other, which is the example shown are rectangular in shape and serve to receive shoulders 36 and cuts 27, respectively, found on the yoke 4 and the armature retaining spring 13. By means of the engagement of the shoulders 36 and the cuts 37, respectively, the yoke 4 and the armature retaining spring 13 are immobilized in the pan.

During the assembly of the compact minirelay formed in this manner, initially the excitation winding with the yoke and the armature retaining spring are inserted in the U-shaped molding from above or through one of the two open sides. The two plate bodies 23 are then applied to the molding 24, wherein the recesses 33 receive the shoulders 36 and the cuts 37, respectively of the yoke and the armature retaining spring, whereupon the plate bodies 23 are solidly bonded to the molding 24 by means of ultrasonic welding.

Figure 12:
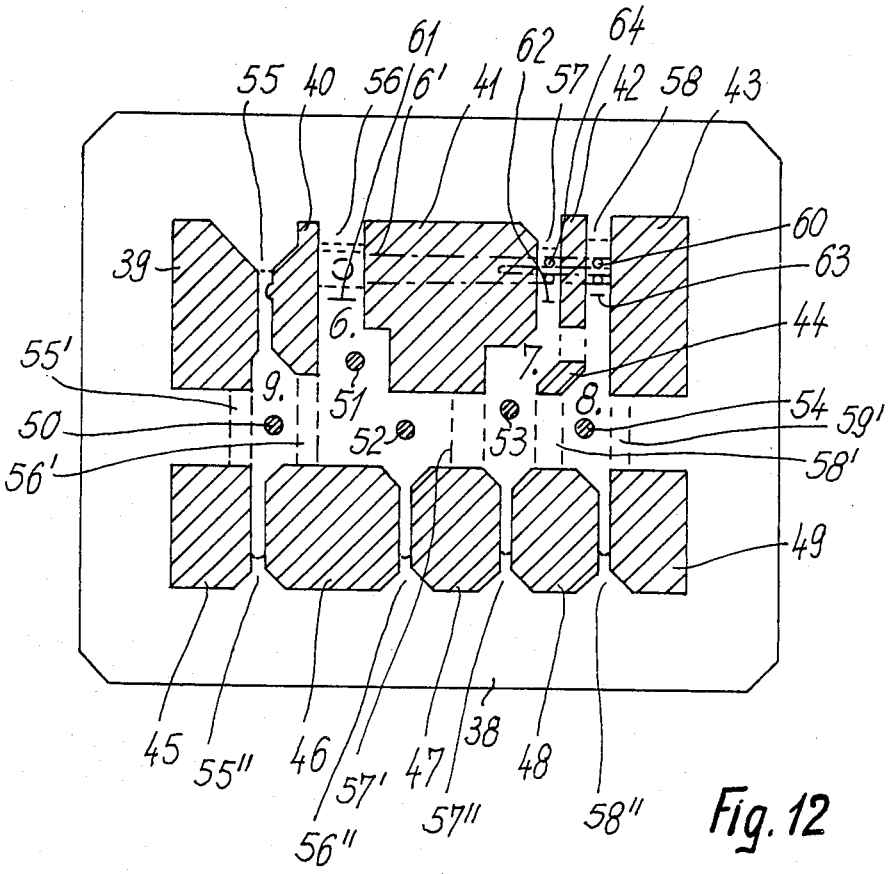
FIG. 12 is a sectional view of a set of springs in a top view.

In FIG. 12, the numeral 38 identifies a metal strip, for example a thin strip of string metal, which may be uncoiled from a supply roll (not shown) or which may be present in the form of a small frame. By means of a cutting tool comprising the dies 39 to 54, initially the connections 6, 7, 8 and 9 and the connecting strips 55, 56, 57, 58, 55', 56', 57', 58', 59' and 55'', 56'', 57'', 58'' are cut out. Following the welding of a switch spring 6' carrying contacts to the connection 6 and of the stationary contacts 60 to the connections 7 and 8, the connections 6, 7, 8, 9 are freed of the connecting strips 55, 56, 57, 58 and the connections 6, 7, 8 bent along the bending lines 61, 62, 63, also the connecting strips 55', 56', 57',58', 59' cut away. The remaining cut part is then inserted in the housing 1 or the plate parts 19, 20 or the plate bodies 22, 23, respectively, and the connections 6, 7, 8, 9 cut away from the connecting strips 55'', 56'', 57'', 58''.

We claims:

1. In a compact minirelay having a box-shaped housing having side walls having upper edges bounding an open top and end walls within which are located an exciter coil, a yoke, an armature, a switch and contact springs, and a hooded lid closing the open top of said housing, the improvement comprising:

lead conductors extending from said switch contact springs and exciter coil therefrom along the outside of said side walls and plate-like parts overlying and immobilizing said lead conductors against said side walls.

2. A compact minirelay as defined in claim 1 wherein said lead conductors lie in recesses formed in the outer surfaces of said side walls and facing recesses in said plate-like parts.

3. A compact minirelay as defined in claim 1 wherein said plate-like parts are firmly bonded to said side walls.

4. A compact minirelay as defined in claim 1 wherein said plate-like parts have portions extending over said upper edges and hold said yoke in said housing.

5. A compact minirelay as defined in claim 1 wherein the upper portions of said plate-like parts and end walls define rabbets receiving portions of said lid.

6. A compact minirelay as defined in claim 2 wherein there are two sets of said contact springs in said housing, said lid having a rib on the inside thereof and extending between said sets of contact springs to define at least a portion of a separating wall therebetween.

* * * * *